US011326384B2

(12) United States Patent
Yaman et al.

(10) Patent No.: US 11,326,384 B2
(45) Date of Patent: May 10, 2022

(54) AUTOMATIC DOOR OPENING SYSTEM AND A METHOD THEREOF

(71) Applicant: VESTEL BEYAZ ESYA SANAYI VE TICARET ANONIM SIRKETI, Manisa (TR)

(72) Inventors: Melih Yaman, Manisa (TR); Burak Ozertug, Manisa (TR)

(73) Assignee: VESTEL BEYAZ ESYA SANAYI VE TICARET ANONIM SIRKETI, Manisa (TR)

( * ) Notice: Subject to any disclaimer, the term of this patent is extended or adjusted under 35 U.S.C. 154(b) by 247 days.

(21) Appl. No.: 16/787,688

(22) Filed: Feb. 11, 2020

(65) Prior Publication Data

US 2020/0263478 A1 Aug. 20, 2020

(30) Foreign Application Priority Data

Feb. 19, 2019 (TR) ..... 2019/02445

(51) Int. Cl.
*E05F 15/616* (2015.01)
*A47L 15/42* (2006.01)
*F25D 23/02* (2006.01)

(52) U.S. Cl.
CPC ..... *E05F 15/616* (2015.01); *A47L 15/4259* (2013.01); *E05Y 2900/30* (2013.01); *E05Y 2900/606* (2013.01); *F25D 23/028* (2013.01)

(58) Field of Classification Search
None
See application file for complete search history.

(56) References Cited

U.S. PATENT DOCUMENTS

| | | | | |
|---|---|---|---|---|
| 6,286,441 | B1 * | 9/2001 | Burdi | A47B 9/00 108/147 |
| 6,338,536 | B1 * | 1/2002 | Ueno | E05B 17/0033 312/405 |
| 8,240,257 | B2 * | 8/2012 | Frost | A47B 13/00 108/20 |
| 8,653,767 | B2 * | 2/2014 | Kim | E05B 17/0029 318/282 |
| 10,577,843 | B2 * | 3/2020 | Lee | F25D 23/028 |
| 10,900,271 | B2 * | 1/2021 | Eom | E05F 15/614 |
| 10,927,587 | B2 * | 2/2021 | Lee | E05F 15/616 |
| 11,072,960 | B2 * | 7/2021 | Lee | F25D 29/005 |
| 11,073,327 | B2 * | 7/2021 | Kim | F25D 23/087 |
| 2008/0134698 | A1 * | 6/2008 | Cho | F25D 23/028 62/127 |

(Continued)

FOREIGN PATENT DOCUMENTS

| | | | | |
|---|---|---|---|---|
| CN | 1284642 A | * | 2/2001 | E05F 15/60 |
| CN | 104833163 A | * | 8/2015 | |

(Continued)

*Primary Examiner* — Hanh V Tran
(74) *Attorney, Agent, or Firm* — Notaro, Michalos & Zaccaria P.C.

(57) ABSTRACT

An automatic door opening system suitable for use in an electrical device having a body with an inner chamber, a door hinged to the body from one side, and a processing unit, the automatic door opening system having a rod that allows the door to open by applying a pushing force to the door while moving in a forward direction, and allows the door to be released when the rod brings into the backward position by moving in the backward direction.

7 Claims, 4 Drawing Sheets

(56) References Cited

U.S. PATENT DOCUMENTS

| | | | | |
|---|---|---|---|---|
| 2010/0141107 | A1* | 6/2010 | Kim | F25D 23/028 312/405 |
| 2011/0048060 | A1* | 3/2011 | Kim | F25D 23/028 62/449 |
| 2011/0279004 | A1* | 11/2011 | Assmann | A47L 15/4259 312/228 |
| 2014/0306596 | A1* | 10/2014 | Linke | E05F 15/611 312/405 |
| 2017/0284144 | A1* | 10/2017 | Yasaka | E06B 3/36 |
| 2018/0119475 | A1* | 5/2018 | Kim | E05F 15/614 |
| 2018/0187470 | A1* | 7/2018 | Song | F25D 11/02 |
| 2020/0131835 | A1* | 4/2020 | Cheng | F25D 25/025 |

FOREIGN PATENT DOCUMENTS

| | | | | | |
|---|---|---|---|---|---|
| CN | 105627661 | A | * | 6/2016 | |
| CN | 106593176 | A | * | 4/2017 | |
| CN | 106642947 | A | * | 5/2017 | F25D 23/028 |
| CN | 107062774 | A | * | 8/2017 | F25D 23/028 |
| CN | 107655255 | A | * | 2/2018 | |
| CN | 108457549 | A | * | 8/2018 | |
| CN | 108692511 | A | * | 10/2018 | |
| CN | 108868441 | A | * | 11/2018 | |
| EP | 3086063 | A1 | * | 10/2016 | E05F 15/616 |
| EP | 3086064 | A1 | * | 10/2016 | E05F 15/619 |
| JP | 2000320955 | A | * | 11/2000 | E05F 15/619 |
| JP | 2001055863 | A | * | 2/2001 | F25D 23/028 |
| JP | 6378069 | B2 | * | 8/2018 | |
| KR | 2012003772 | A | * | 1/2011 | |
| KR | 20170014565 | A | * | 2/2017 | |
| KR | 20180113159 | A | * | 10/2018 | |
| KR | 20180119028 | A | * | 11/2018 | |
| KR | 20180119031 | A | * | 11/2018 | |
| KR | 20180119985 | A | * | 11/2018 | |
| WO | WO-2016200050 | A1 | * | 12/2016 | E05F 15/619 |
| WO | WO-2017018865 | A1 | * | 2/2017 | E05F 15/619 |
| WO | WO-2018084657 | A1 | * | 5/2018 | E05F 5/12 |
| WO | WO-2018199600 | A1 | * | 11/2018 | F25D 23/028 |

* cited by examiner

AUTOMATIC DOOR OPENING SYSTEM AND A METHOD THEREOF

TECHNICAL FIELD

The present invention relates to an automatic door opening system suitable for use in electrical devices, and a control method for said system.

BACKGROUND OF THE INVENTION

Current electrical devices such as refrigeration devices, washing devices and the like comprise a body having an inner chamber, and a door which is hinged to the body from one side and controls access into the inner chamber upon being brought into an opened-closed position. The door can be opened and closed manually by a user, and in addition to that, various systems are used through which the door can be opened automatically by a user command or a certain algorithm. Said systems comprise a motor, a shaft which is connected to the motor, a gear mechanism in connection with the shaft, and a pushing unit which moves forward as a result of a rotational movement of the gear mechanism to apply a pushing force to the door. The pushing unit allows the door to open by applying a pushing force to the door from one side thereof, e.g. from a side opposite to the side from which the door is hinged to the body.

US20110279004A1 discloses a door opening system which is developed for washing devices, in particular for dishwashers. The system comprises a locking mechanism which allows the door to be kept in the closed position and is opened by a pushing force applied. The system also comprises a pushing mechanism for at least opening the door slightly and having a pushing unit that is driven by a motor. However, in said system, it may be required by a user to push the door, which is opened by the mechanism, to close the door, which may damage the mechanism itself. Furthermore, if there is an obstruction in front of the door, forcing the door to open by the system will damage the motor and the whole mechanism. Similarly, in case a power cut occurs while opening the door by the mechanism, the pushing unit may remain in the forward position, and in this case, pushing the door by the user to close may damage the system.

BRIEF DESCRIPTION OF THE INVENTION

The automatic door opening system according to the present invention is suitable for use in an electrical device which comprises at least one body having at least one inner chamber, at least one door hinged to the body from one side and controlling access into the inner chamber upon being brought into an opened-closed position, and at least one processing unit for controlling and coordinating functions of the device, the automatic door opening system comprising: at least one rod which allows the door to open by applying a pushing force to the door from one side thereof while moving in a forward direction, and allows the door to be released when the rod brings into the backward position by moving in the backward direction; at least one motor; at least one electrical circuit for allowing the motor to perform bidirectional rotational movement by using a single voltage input; at least one shaft which is in connection with the motor and is able to rotate around its own axis by means of rotational movement of the motor; at least one gear mechanism which is in connection with the shaft and the rod, allows the rod to move forward as a result of rotation of the motor in a first direction by transferring the rotational movement of the motor from the shaft to the rod, and allows the rod to move backward as a result of rotation of the motor in a second direction; at least one memory unit for storing the time during which the motor performs its rotational movement while the rod is moved forward; and at least one control unit which is in connection with the processing unit, the memory unit and the motor, which, when the rod is in the backward position, allows the motor to move in a first direction when a command for opening the door is received from the processing unit, which allows the motor to stop when the door is brought into the opened position, and which, when a command for releasing the door is received from the processing unit, allows the motor to rotate in the second direction for a time that is stored at the memory unit, thus allowing the rod to move in the backward direction for as long as it has moved in the forward direction so that the rod is returned to the backward position.

The control method of the present invention comprises the steps of: transmitting by the processing unit to the control unit a command for opening the door when the door is closed and the rod is in the backward position; moving the motor by the control unit in the first direction so that the rod applies a pushing force to the door; stopping the motor by the control unit when the door is brought into an opened position; storing, at the memory unit, the time during which the motor moves in the first direction until the door is brought into the opened position; transmitting by the processing unit to the control unit a command for releasing the door; and moving the motor by the control unit in the second direction for a time that is stored at the memory unit, so that the rod is returned into the backward position.

OBJECT OF THE INVENTION

An object of the present invention is to provide an automatic door opening system suitable for use in electrical devices, and a control method for said system.

Another object of the present invention is to provide an automatic door opening system which, by means of the bidirectional movement of the motor, allows the door to be released after being opened, and a control method for said system.

A further object of the present invention is to provide an automatic door opening system in which the mechanism is prevented from being damaged if there is an obstruction in front of the door, and a control method for said system.

Yet a further object of the present invention is to provide an automatic door opening system in which the mechanism is prevented from being damaged in case a power cut occurs while opening the door, and a control method for said system.

DESCRIPTION OF THE DRAWINGS

Exemplary embodiments of the automatic door opening system and the control method according to the present invention are illustrated in the attached drawings, in which.

Figure 1:
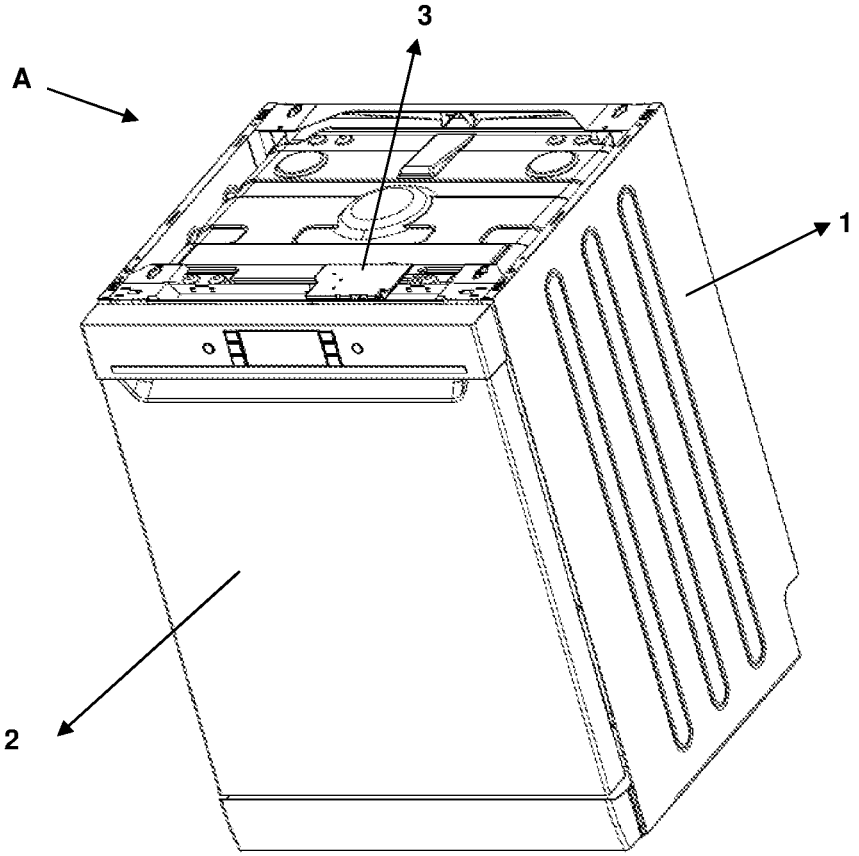
FIG. 1 is a perspective view of an exemplary usage of the door opening system according to the invention.
Figure 2:
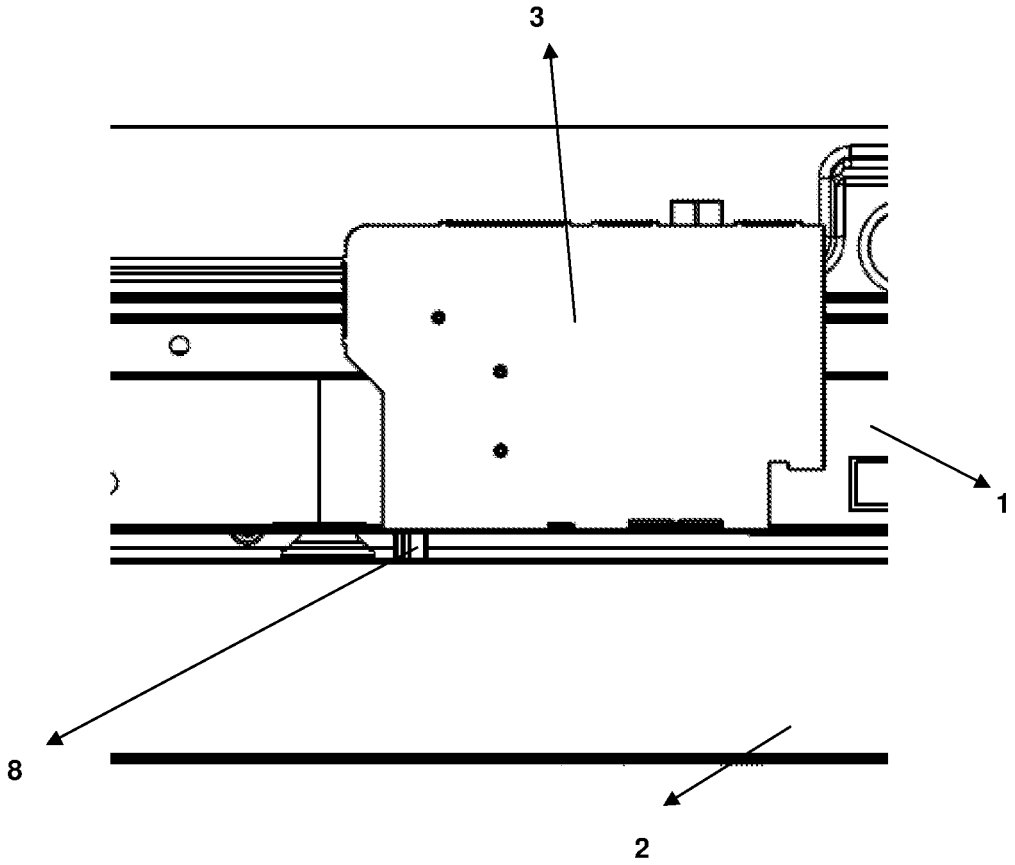
FIG. 2 is a top view of an exemplary usage of the door opening system according to the invention.
Figure 3:
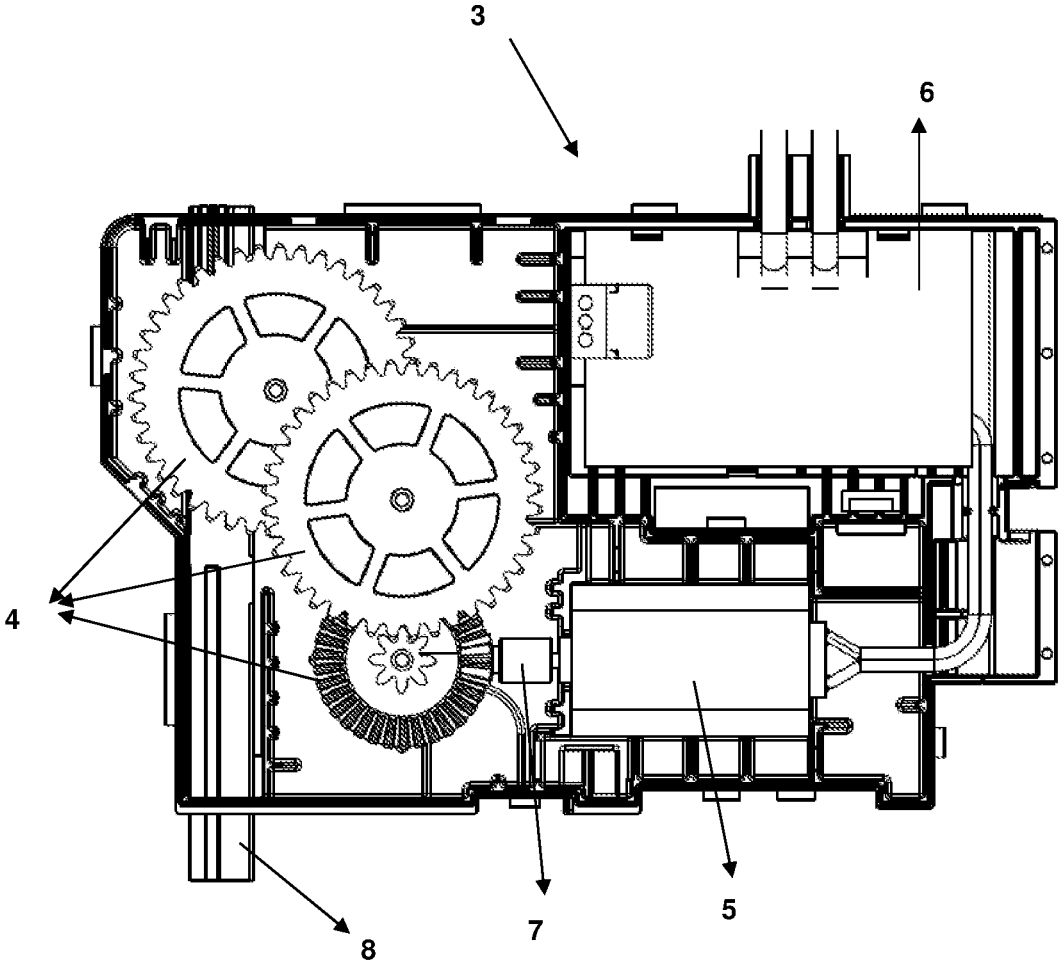
FIG. 3 is another top view of an exemplary usage of the door opening system according to the invention.
Figure 4:
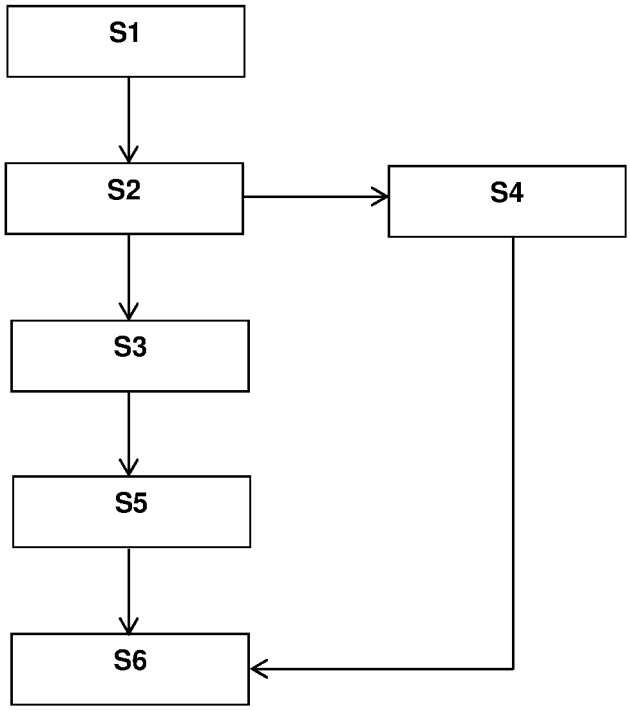
FIG. 4 is a flowchart of an exemplary embodiment of the control method according to the invention.

All the parts illustrated in figures are individually assigned a reference numeral and the corresponding terms of these numbers are listed below:

(A) Electrical device
(1) Body
(2) Door
(3) Automatic door opening system
(4) Gear mechanism
(5) Motor
(6) Control unit
(7) Shaft
(8) Rod
(S1) Transmitting by the processing unit to the control unit a command for opening the door when the door is closed and the rod is in the backward position
(S2) Moving the motor by the control unit in the first direction
(S3) Stopping the motor by the control unit when the door is brought into the opened position
(S4) Storing at the memory unit the time during which the motor moves in the first direction until the door brings into the opened position
(S5) Transmitting by the processing unit to the control unit a command for releasing the door
(S6) Moving, by the control unit, the motor in the second direction for a time that is stored at the memory unit

DESCRIPTION OF THE INVENTION

Current electrical devices such as refrigeration devices, washing devices and the like comprise a body having an inner chamber, and a door which is hinged to the body from one side and controls access into the inner chamber upon being brought into an opened-closed position. The door can be opened and closed manually by a user, and in addition to that, various systems are used through which the door can be opened automatically by a user command or a certain algorithm. Said systems comprise a motor, a shaft which is connected to the motor, a gear mechanism in connection with the shaft, and a pushing unit which moves forward as a result of a rotational movement of the gear mechanism to open the door. However, sometimes it may be required by a user to push the door to close it, which may damage the mechanism provided in said systems. Furthermore, if there is an obstruction in front of the door, forcing the door to open by the system may damage the mechanism, and in case a power cut occurs while opening the door, the pushing unit may remain in the forward position. Therefore, with the present invention, there is provided an automatic door opening system for solving abovementioned problems, and a control method for said system.

The automatic door opening system (3) of the present invention is suitable for use in an electrical device (A) which comprises at least one body (1) having at least one inner chamber (not shown in figures), at least one door (2) hinged to the body (1) from one side and controlling access into the inner chamber upon being brought into an opened-closed position, and at least one processing unit (not shown in figures) for controlling and coordinating functions of the device (A), the automatic door opening system (3) comprising: at least one rod (8) which allows the door (2) to open by applying a pushing force to the door (2) from one side thereof, preferably from a side opposite to the side from which the door (2) is hinged to the body (1), while moving in a forward direction, and allows the door (2) to be released when the rod (8) brings into the backward position by moving in the backward direction (when the rod (8) is brought into the backward position, the door (2) is released such that the user can push the door (2) to close it); at least one motor (5) (e.g. a DC motor); at least one electrical circuit (e.g. a H-bridge circuit) (not shown in figures) for allowing the motor (5) to perform bidirectional rotational movement (i.e. clockwise and anticlockwise) by using a single voltage input (e.g. 12V); at least one shaft (7) which is in connection with the motor (5) and is able to rotate around its own axis by means of rotational movement of the motor (5); at least one gear mechanism (4) which is in connection with the shaft (7) and the rod (8), allows the rod (8) to move forward (towards the door) as a result of rotation of the motor (5) in a first direction (e.g. clockwise or anticlockwise) by transferring the rotational movement of the motor (5) from the shaft (7) to the rod (8), and allows the rod (8) to move backward (from the door (2) towards the body (1)) as a result of rotation of the motor (5) in a second direction (e.g. anticlockwise or clockwise), wherein the system also comprises: at least one memory unit (not shown in figures) for storing the time during which the motor (5) performs its rotational movement while the rod (8) is moved forward; and at least one control unit (6) which is in connection with the processing unit, the memory unit and the motor (5), which, when the rod (8) is in the backward position, allows the motor (5) to move in a first direction when a command for opening the door (2) is received from the processing unit, which allows the motor (5) to stop when the door (2) is brought into the opened position, and which, when a command for releasing the door (2) is received from the processing unit, allows the motor (5) to rotate in the second direction for a time that is stored at the memory unit and equals to the time during which the motor (5) has moved in the first direction, thus allowing the rod (8) to move in the backward direction for as long as it has moved in the forward direction so that the rod (8) is returned to the backward position.

In an exemplary embodiment of the invention, when the door (2) is closed, the rod (8) is in the backward position in which no pushing force is applied to the door (2). If a command for opening the door (2) is transmitted to the control unit (6) by the processing unit (the command may be generated by an algorithm stored in the processing unit or as a result of a process performed by the user [e.g. a command issued by the user via a data input unit]), the control unit (6) allows the motor (5) to rotate in the first direction. Movement of the motor (5) in the first direction is transferred to the rod (8) by the shaft (7) and the gear mechanism (4) such that the rod (8) moves forward and applies a pushing force to the door (2). When the door (2) is brought into an opened position, the control unit (6) stops the movement of the motor (5). While the door (2) is opened, the time during which the motor (5) performs rotational movement in the first direction is saved by the memory unit. When a command for releasing the door (2) is received from the processing unit (the command may be generated by an algorithm stored in the processing unit or as a result of a process performed by the user [e.g. a command issued by the user via a data input unit]), the control unit (6) allows the motor (5) to move in the second direction for the time stored at the memory unit so that the rod (8) is returned to the backward position in which the rod (8) is wholly in its initial position. Thus, the door (2) is released such that the user can push the door (2) to close it, and the system is prevented from being damaged in case the user tries to close the door (2) by pushing.

In a preferred embodiment of the invention, the control unit (6) and the processing unit may be provided as a single unit. In said embodiment, functions of the control unit (6) are integrated into the processing unit.

In a preferred embodiment of the invention, the automatic door opening system (3) comprises an internal power source (not shown in figures) which is in connection with the motor (5) and the control unit (6). In said embodiment, the rod (8) is able to be moved by using the internal power source, in case a power cut occurs.

In a preferred embodiment of the invention, the control unit (6) is also arranged to monitor the current drawn by the motor (5) during movement of the motor (5) in the first direction and the second direction, and compare it with a threshold value.

The control method of the present invention comprises the steps of: transmitting by the processing unit to the control unit (6) a command for opening the door (2) when the door (2) is closed and the rod (8) is in the backward position (S1); moving the motor (5) by the control unit (6) in the first direction (S2) so that the rod (8) applies a pushing force to the door (2); stopping the motor (5) by the control unit (6) when the door (2) is brought into the opened position (S3); storing at the memory unit the time during which the motor (5) moves in the first direction until the door (2) brings into the opened position (S4); transmitting by the processing unit to the control unit (6) a command for releasing the door (2) (S5); and moving, by the control unit (6), the motor (5) in the second direction for a time that is stored at the memory unit (S6), so that the rod (8) is returned into the backward position.

In a preferred embodiment of the invention, the control method also comprises the steps of: monitoring, by the control unit (6), the current drawn by the motor (5) during movement of the motor (5) in the first direction, and comparing it with a threshold value; stopping the motor (5) if the current drawn by the motor (5) is above the threshold value; and rotating, by the control unit (6), the motor (5) in the second direction for a time that is stored at the memory unit and equals to the time during which the motor (5) has moved in the first direction so that the rod (8) is returned to the backward position. With said embodiment, if there is an obstruction in front of the door (2) while the door (2) is opened, increase in the current drawn by the motor (5) is able to be detected by means of the effect of the force applied to the rod (8) in the opposite direction. Therefore, gears (4) of the system, the motor (5) and the electronic units are prevented from being damaged, and the rod (8) can return its initial position (backward position) in a safe manner.

In a preferred embodiment of the invention, the control unit (6) monitors the current drawn by the motor (5) during movement of the motor (5) in the second direction and compares it with the threshold value, and if the current exceeds the threshold value, allows the motor (5) to stop and an error code to be transmitted to the processing unit.

In a preferred embodiment of the invention, in case a power cut occurs during movement of the motor (5) in the first direction, when the power supply to the device is provided again (i.e. when power cut is corrected), the control unit (6) allows the motor (5) to be moved in the second direction for the time stored at the memory unit. In said embodiment, when the power cut is corrected, the motor (5) is allowed to move in the second direction for the time during which the motor (5) has moved in the first direction until the power cut, and the rod (8) is allowed to return to backward position.

In a preferred embodiment of the invention, in case a power cut occurs, the control unit (6) uses the internal power source to bring the rod (8) into the backward position without waiting for the power cut to be corrected. In said embodiment, the control unit (6) stops the motor (5) in case a power cut occurs, and uses the internal power source to move the motor (5) in the second direction for the time stored at the memory unit. Said embodiment finds advantageous application in, for example, refrigeration devices for which long opening time of the door (2) may cause a problem.

With the automatic door system (3) and control method of the present invention, motor (5) of the system is operated in both directions for equal times, thus the rod (8) is allowed to return to its initial position in a safe manner in case of power cuts or obstructions in front of the door (2). Therefore, any damage that could occur at the system or the device is prevented.

The invention claimed is:

1. An automatic door opening system (3) suitable for use in an electrical device (A) which comprises at least one body (1) having at least one inner chamber, at least one door (2) hinged to the body (1) from one side and controlling access into the inner chamber upon being brought into an opened-closed position, and at least one processing unit for controlling and coordinating functions of the device, the automatic door opening system (3) comprising: at least one rod (8) which allows the door (2) to open by applying a pushing force to the door (2) from one side thereof while moving in a forward direction, and allows the door (2) to be released when the rod (8) brings into the backward position by moving in the backward direction; at least one motor (5); at least one electrical circuit for allowing the motor (5) to perform bidirectional rotational movement by using a single voltage input; at least one shaft (7) which is in connection with the motor (5) and is able to rotate around its own axis by means of rotational movement of the motor (5); at least one gear mechanism (4) which is in connection with the shaft (7) and the rod (8), allows the rod (8) to move forward as a result of rotation of the motor (5) in a first direction by transferring the rotational movement of the motor (5) from the shaft (7) to the rod (8), and allows the rod (8) to move backward as a result of rotation of the motor (5) in a second direction, characterized by comprising at least one memory unit for storing the time during which the motor (5) performs its rotational movement while the rod (8) is moved forward; and at least one control unit (6) which is in connection with the processing unit, the memory unit and the motor (5), which, when the rod (8) is in the backward position, allows the motor (5) to move in a first direction when a command for opening the door (2) is received from the processing unit, which allows the motor (5) to stop when the door (2) is brought into the opened position, and which, when a command for releasing the door (2) is received from the processing unit, allows the motor (5) to rotate in the second direction for a time that is stored at the memory unit and equals to the time during which the motor (5) has moved in the first direction, thus allowing the rod (8) to move in the backward direction for as long as it has moved in the forward direction so that the rod (8) is returned to the backward position.

2. An automatic door opening system (3) according to claim 1, characterized in that the control unit (6) and the processing unit are provided as a single unit.

3. A control method for an automatic door opening system (3) according to claim 1, characterized by comprising the steps of: transmitting by the processing unit to the control unit (6) a command for opening the door (2) when the door (2) is closed and the rod (8) is in the backward position (S1); moving the motor (5) by the control unit (6) in the first direction (S2) so that the rod (8) applies a pushing force to the door (2); stopping the motor (5) by the control unit (6) when the door (2) is brought into the opened position (S3); storing at the memory unit the time during which the motor moves in the first direction until the door (2) brings into the opened position (S4); transmitting by the processing unit to the control unit (6) a command for releasing the door (2) (S5); and moving, by the control unit (6), the motor (5) in the second direction for a time that is stored at the memory unit (S6), so that the rod (8) is returned into the backward position.

4. A control method according to claim 3, characterized by comprising the steps of: monitoring, by the control unit (6), the current drawn by the motor (5) during movement of the motor (5) in the first direction and comparing it with a threshold value; stopping the motor (5) if the current drawn by the motor (5) is above the threshold value; and rotating, by the control unit (6), the motor (5) in the second direction for a time that is stored at the memory unit and equals to the time during which the motor (5) has moved in the first direction so that the rod (8) is returned to the backward position.

5. A control method according to claim 4, characterized by comprising the steps of: monitoring, by the control unit (6), the current drawn by the motor (5) during movement of the motor (5) in the second direction and comparing it with the threshold value, and if the current exceeds the threshold value, allowing the motor (5) to stop and an error code to be transmitted to the processing unit.

6. A control method according to claim 3, characterized by comprising the step of: in case a power cut occurs during movement of the motor (5) in the first direction, when the power supply to the device is provided again, allowing, by the control unit (6), the motor (5) to be moved in the second direction for the time that is stored at the memory unit and equals to the time during which the motor (5) has moved in the first direction.

7. A control method according to claim 6, characterized by comprising the step of: in case a power cut occurs, using, by the control unit (6), the internal power source to bring the rod (8) into the backward position without waiting for the power cut to be corrected.

* * * * *